US006247797B1

(12) United States Patent
Newcombe et al.

(10) Patent No.: US 6,247,797 B1
(45) Date of Patent: Jun. 19, 2001

(54) METHOD AND APPARATUS FOR EJECTING PARTICULATE MATERIAL INCLUDING SECONDARY ELECTRODE DISPOSED TRANSVERSE TO A ROW OF EJECTION ELECTRODES

(75) Inventors: Guy Charles Fernley Newcombe; Neil Emerton; John Teape; Richard Wilhelm Janse Van Rensburg; Peter John Taylor, all of Cambridge (GB)

(73) Assignee: Tonejet Corporation PTY, Ltd., Eastwood (AU)

( * ) Notice: Subject to any disclaimer, the term of this patent is extended or adjusted under 35 U.S.C. 154(b) by 0 days.

(21) Appl. No.: 09/101,890

(22) PCT Filed: Feb. 22, 1997

(86) PCT No.: PCT/GB97/00186

§ 371 Date: Jul. 17, 1998

§ 102(e) Date: Jul. 17, 1998

(87) PCT Pub. No.: WO97/27056

PCT Pub. Date: Jul. 31, 1997

(30) Foreign Application Priority Data

Jan. 22, 1996 (GB) ..... 9601226

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 3,887,928 * 6/1975 Ohno et al. .
4,477,869 * 10/1984 Rudd, III .
4,568,955 * 2/1986 Hosoya et al. .

FOREIGN PATENT DOCUMENTS

WO 93/11866 * 6/1993 (AU) .
0703080 A2 * 3/1996 (EP) .
57 -027759 * 2/1982 (JP) .
57-027760 * 2/1982 (JP) .
01206062 * 6/1993 (JP) .

* cited by examiner

*Primary Examiner*—John Barlow
*Assistant Examiner*—Raquel Yvette Gordon
(74) *Attorney, Agent, or Firm*—Dykema Gossett, PLLC

(57) ABSTRACT

An apparatus for ejecting material from a liquid has an ejection location 91) with an electrode (3). An electrical potential is applied to the ejection location electrode to form an electric field at the location together; liquid is supplied to the ejection location which contains the particulate material to be ejected from the ejection location. A secondary electrode (5, 8) is disposed adjacent to the ejection location and the voltage on the ejection location electrode is controllable so as to reduce the sensitivity of the head to influence by external electric fields.

19 Claims, 6 Drawing Sheets

METHOD AND APPARATUS FOR EJECTING PARTICULATE MATERIAL INCLUDING SECONDARY ELECTRODE DISPOSED TRANSVERSE TO A ROW OF EJECTION ELECTRODES

BACKGROUND OF THE INVENTION

The present invention relates to a method of and apparatus for ejecting material from a liquid. More particularly, the method and apparatus employed may be generally of the type described in WO-A-93-11866, PCT/GB95/01215 and WO-A-94-18011, the disclosure of which is incorporated by reference. In the methods described in these patent applications an agglomeration or concentration of particles is achieved at an ejection location and from the ejection location particles are then ejected onto a substrate, eg. for printing purposes. In the case of an array printer, plural cells may be arranged in one or more rows. In other types of printing apparatus, in which charged liquid droplets are jetted onto a substrate, such as shown in JP-A-05 116 322, U.S. Pat. Nos. 3,060,429 & 3,887,928, additional electrodes may be provided for guiding the charged droplets to a charged substrate.

It is thus known in the art to generate and eject particles by use of electrostatic fields, but problems exist with this type of ejection, such as (a) controlling the direction of movement of ejected droplets or particles, which depends upon close control of the electrostatic field in the vicinity of the ejection electrode, (b) the difficulty of switching and the remote location of electrical earthing, (c) the dependence of ejection on the gap between the ejection electrode and substrate, and (d) the attraction of airborne particles into the ejector during the application of the electrostatic field.

SUMMARY OF THE INVENTION

According to the present invention there is provided an apparatus for ejecting particulate material from a liquid, the apparatus comprising a plurality of ejection locations disposed in a linear array, each ejection location having a corresponding ejection electrode, whereby the ejection electrodes are disposed in a row defining a plane; means to apply an electrical potential to the ejection electrodes to form an electric field at the ejection locations; means for supplying liquid containing the particulate material to the ejection locations; and a secondary electrode disposed transverse to the plane of the ejection electrodes.

A plurality of secondary electrodes may be provided or else a secondary electrode common to the ejection locations.

Thus, the sensitivity of the apparatus to influence by external electric fields may be reduced as may its sensitivity to variations in the distance between the ejection location and the substrate onto which the particles are ejected.

The invention also includes a method of operating such apparatus to eject agglomerations of particles onto the substrate.

In use the voltage on the secondary electrode or electrodes relative to the voltage of the ejection electrodes is controlled by a suitable electronic control circuit.

The use of a secondary electrode is particularly advantageous in such an array system in which there are a plurality of cells in a row to reduce the number of connections necessary to the electrodes at the ejection location. For example, by connecting adjacent electrodes at the electrode location together in pairs and similarly for the secondary electrode the number of connections required for each set of electrodes is reduced by half. Then, by disposing the connected pairs of the secondary electrodes offset with respect to the connected pairs of electrodes at the ejection location, control of ejection and thus of printing can be achieved by selective application of voltages to the electrodes at the ejection location and the secondary electrodes in a "matrix addressing" mode since each ejection location electrode of a connected pair will be disposed opposite a secondary electrode of a different connected pair, ie. the opposing secondary electrodes will not be electrically connected. Thus, ejection voltages can be applied to the ejection location electrodes of a pair and ejection can be individually controlled from each of the respective cells by the application of different voltages on the opposing secondary electrodes. Further multiplexing can be achieved if desired.

Preferably, the secondary electrode is insulated and the ejection electrode is not, but in certain designs both may be non-insulated or both may be insulated or the ejection electrode insulated and the secondary electrode non-insulated.

DETAILED DESCRIPTION OF THE INVENTION

Figure 1:
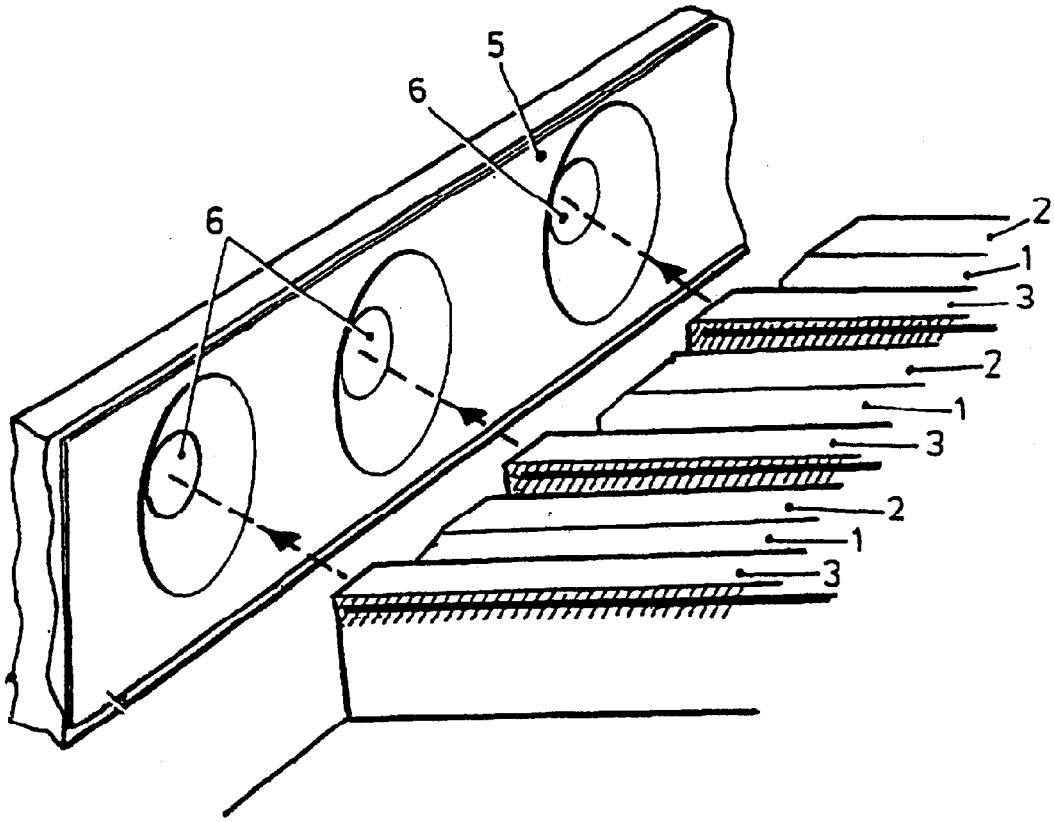
FIG. 1 illustrates part of a printhead having a row of ejection cells and corresponding secondary electrodes.
Figure 2:
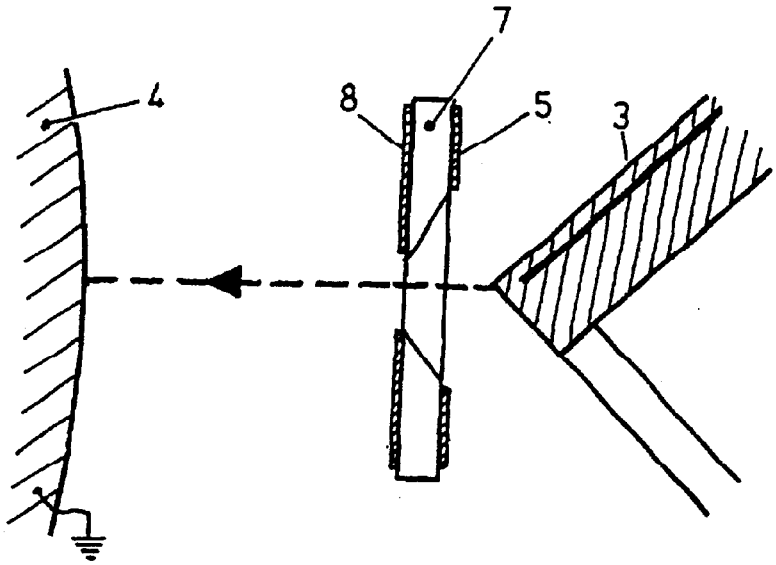
FIG. 2 illustrates the arrangement of FIG. 1 in side view.

FIGS. 1 & 2 illustrate a printhead, diagrammatically, the printhead having plural cells 1 separated by insulating walls 2 and each containing an ejection electrode 3. As described in WO-A-93-11866, agglomerations of particles carried by fluid in each of the cells can be ejected from the cells on application of a voltage to the respective electrodes 3 as indicated by the arrows in FIG. 1. FIG. 2 shows a substrate 4 onto which agglomerations of particles, for example, for printing, are ejected from the cells 1. In order to reduce the sensitivity of the head to variations in the distance between the cells and the substrate 4 a secondary electrode 5, which has plural apertures 6 disposed opposite respective cells 1, is provided in front of the ejection cell. As shown the electrode 5 is disposed on a first side of a support 7 and a further secondary electrode 8 is disposed on the other side. Charged agglomerations of particles emitted from the cells 1 pass through the electrodes 5 and 8 onto the earthed substrate 4.

In one method, for example, the voltages applied to the electrodes may be 1 kV on the ejection electrodes for ejection purposes, 500 V on the secondary electrode 5 and 0V on the further secondary electrode 8. The electrode support 7 may be provided by 150 micron thick glass slips chrome plated on both faces to provide the electrodes 5,8, and with the apertures 6 formed with 45 degree chamfered faces and having a width of 50 microns. The secondary electrode 8 may be separated from the outermost extremity of the ejection cell by a distance of 200 microns. It has been found generally that the closer the secondary electrode structure is to the ejection cell the greater the electric field in the region between them, but this also results in an increase in electrostatic pressure over the whole meniscus. The desired pressure distribution can be restored by increasing the potential on the secondary electrode 5.

Alternatively, voltages on the electrodes may be as described in our British Patent Application 9601232.3, as described below.

There may, in an alternative embodiment, be plural secondary electrodes, for example formed in a manner similar to that of FIGS. 1 & 2, but with the secondary electrodes separately formed, each around a respective aperture 6. Of course, different configuration altogether may be formed if suitable for a given application.

Figure 3:
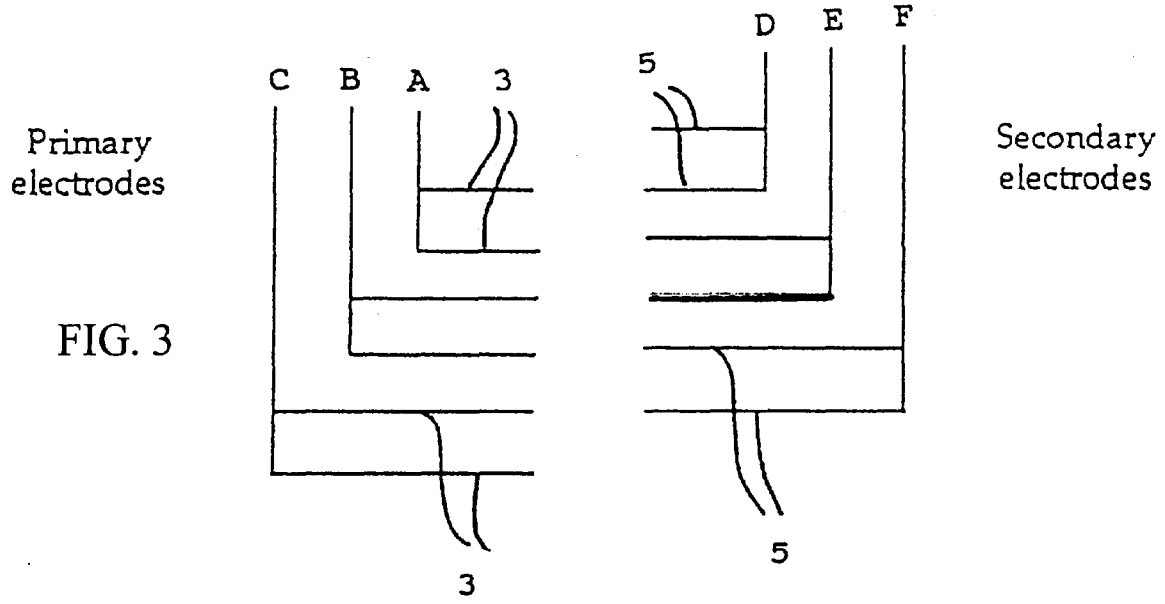
FIG. 3 illustrates, diagrammatically, an arrangement of the electrodes so as to allow addressing of individual ejection electrodes in pairs.

FIG. 3 shows how the primary 3 and secondary 5 electrodes may be offset from one another and connected in pairs A,B,C,D,E,F etc. as referred to above. Thus, the number of connections required for each set of electrodes is reduced by half and by disposing the connected pairs of the secondary electrodes 5 offset with respect to the connected pairs of electrodes 3 at the ejection location, control of ejection and thus of printing can be achieved by selective application of voltages to the electrodes at the ejection location and the secondary electrodes in an "addressing mode" since each ejection location electrode 3 of a connected pair will be disposed opposite a secondary electrode of a different connected pair, ie. the opposing secondary electrodes will not be electrically connected. Thus, ejection voltages can be applied to the ejection location electrodes 3 of a pair and ejection can be individually controlled from each of the respective cells by the application of different voltages on the opposing secondary electrodes.

Figure 4:
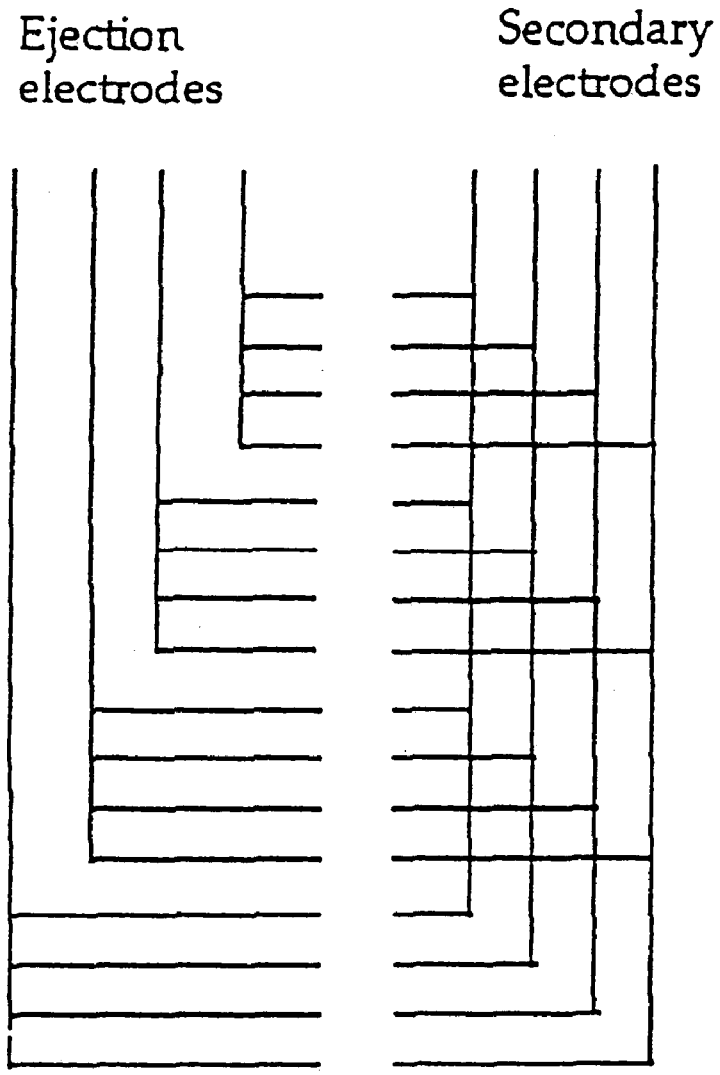
FIG. 4 illustrates, diagrammatically, how secondary electrodes can be used for a matrix addressing mode of operation.

The arrangement shown in FIG. 4 is different again. This arrangement enables a matrix addressing scheme to be utilised to drive the apparatus. This addressing scheme is similar to that used, for example, in flat panel display technology and may be used to address $N^2$ ejection electrodes with 2N address lines. In the illustrated embodiment a 16 ($4^2$) element array is driven by 8 (2×4) address lines. The multiplex advantage is particularly significant with increasing numbers of electrodes, so that, for example, it would be possible to address a head with 256 ($2^8$) electrodes with 16 (2×8) address lines (8 primary and 8 secondary). The detailed connection arrangements of the primary and secondary electrodes can be reversed of course if desired.

As described in our British Patent Application 9601232.3, it may be possible to apply an oscillating voltage to the ejection location, the magnitude of said voltage being below that required to cause ejection of particles from the ejection location; and, a superimposing ejection voltage on the respective secondary electrode additively with the oscillating voltage in order to cause the sum of the voltages at the ejection location to exceed the threshold required for ejection, when required.

Figure 5:
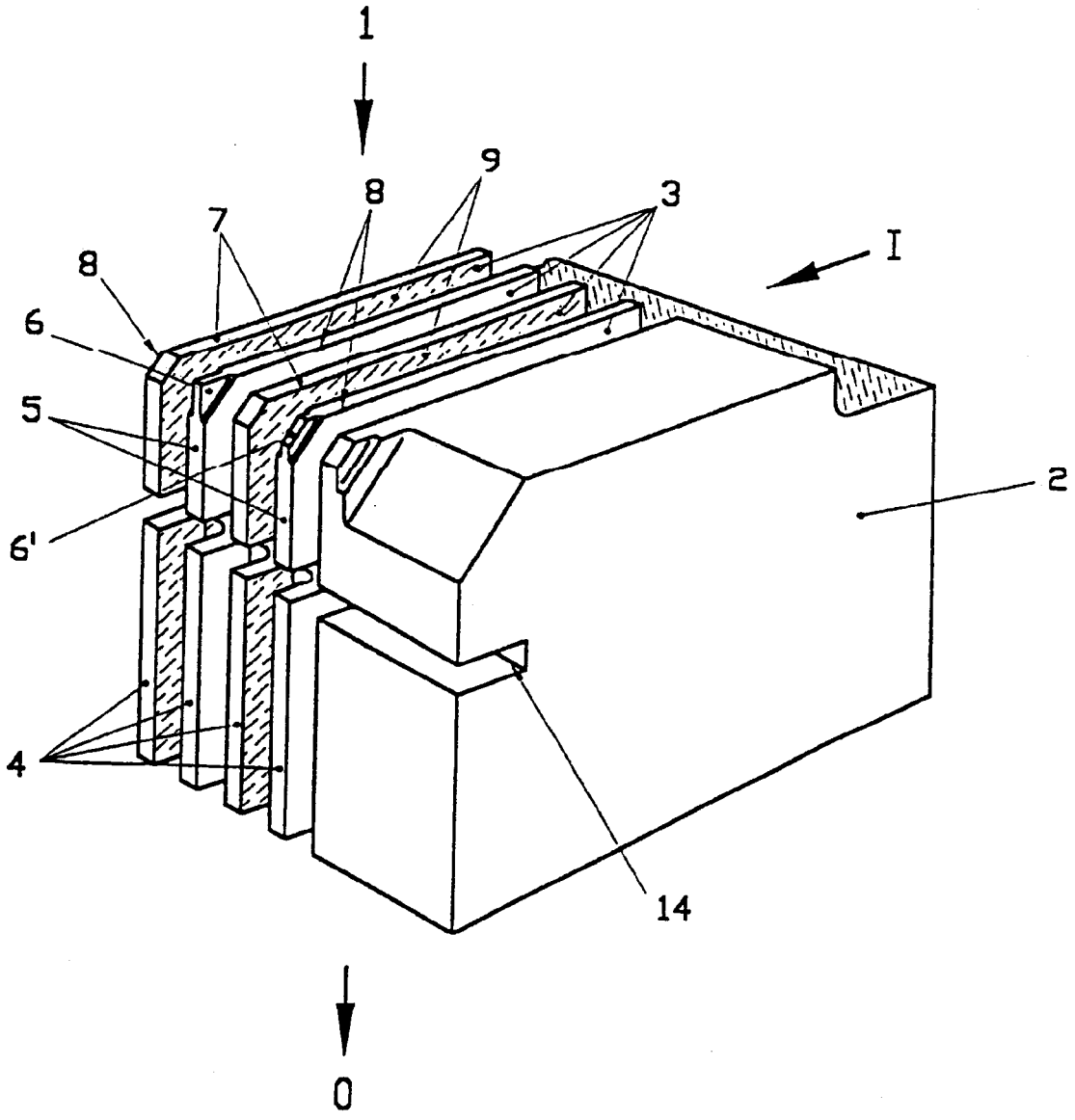
FIG. 5 is a partial perspective view of a portion of a further printhead incorporating ejection apparatus according to the present invention.
Figure 6:
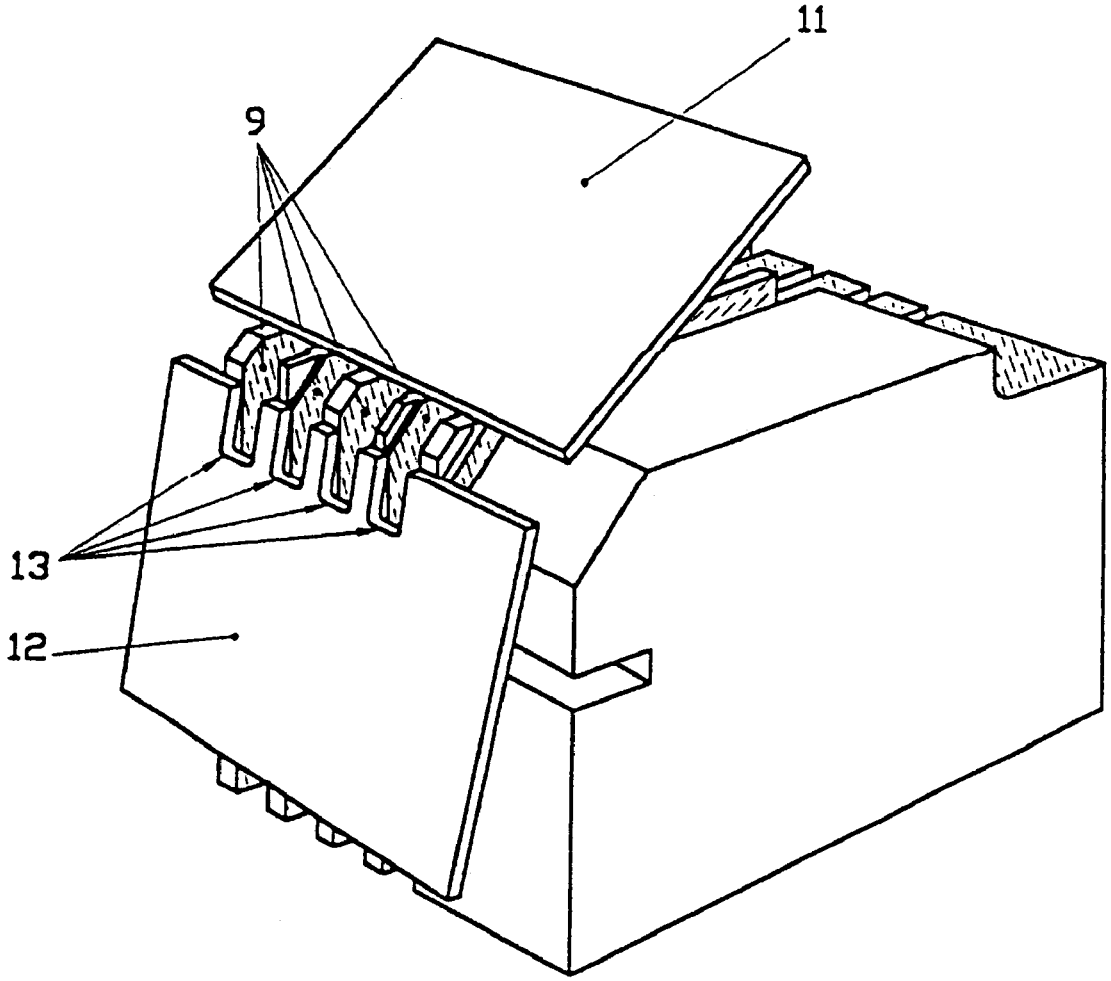
FIG. 6 is a view similar to FIG. 5 showing further and alternative features of the ejection apparatus.
Figure 7:
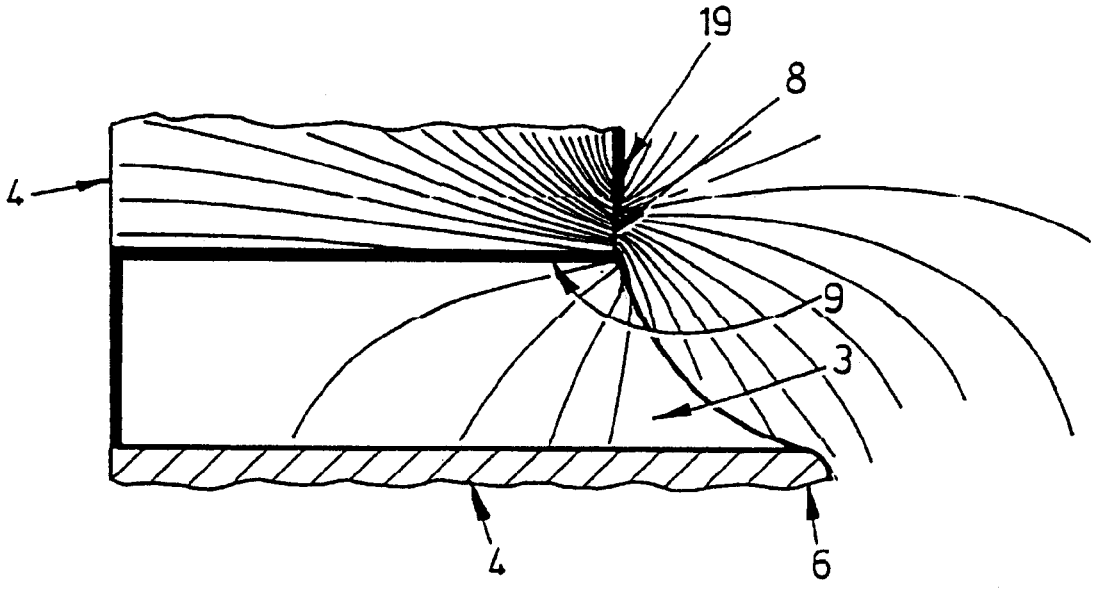
FIG. 7 is a partial sectional views through a cell of FIG. 5.

Other examples are illustrated in FIGS. 5 to 7. FIG. 5 illustrates part of an array-type printhead 1, the printhead comprising a body 2 of a dielectric material such as a synthetic plastics material or a ceramic. A series of grooves 3 are machined in the body 2, leaving interposing late-like lands 4. The grooves 3 are each provided with a ink inlet and ink outlet (not shown, but indicated by arrows I & O) disposed at opposite ends of the grooves 3 so that fluid ink carrying a material which is to be ejected (as described in our earlier applications) can be passed into the grooves and depleted fluid passed out.

Each pair of adjacent grooves 3 define a cell 5, the plate-like land or separator 4 between the pairs of grooves 3 defining an ejection location for the material and having an ejection upstand 6,6'. In the drawing two cells 5 are shown, the left-hand cell 5 having an ejection upstand 6 which is of generally triangular shape and the right-hand cell 5 having a truncated ejection upstand. Each of the cells 5 is separated by a cell separator 7 formed by one of the plate-like lands 4 and the corner of each separator 7 is shaped or chamfered as shown so as to provide a surface 8 to allow the ejection upstand to project outwardly of the cell beyond the exterior of the cell as defined by the chamfered surfaces 8. A truncated ejection upstand 6' is used in the end cell 5 to reduce end effects resulting from the electric fields which in turn result from voltages applied to ejection electrodes 9 provided as metallised surfaces on the faces of the plate-like lands 4 facing the ejection upstand 6,6' (ie. the inner faces of each cell separator). As can be seen from FIG. 7, the ejection electrodes 9 extend over the side faces of the lands 4 and the bottom surfaces 10 of the grooves 3. The precise extent of the ejection electrodes 9 will depend upon the particular design and purpose of the printer.

FIG. 6 illustrates two alternative forms for side covers of the printer, the first being a simple straight-edged cover 11 which closes the sides of the grooves 3 along the straight line as indicated in the top part of the figure. A second type of cover 12 is shown on the lower part of the figure, the cover still closing the grooves 3 but having a series of edge slots 13 which are aligned with the grooves. This type of cover construction may be used to enhance definition of the position of the fluid meniscus which is formed in use and the covers, of whatever form, can be used to provide surfaces onto which the ejection electrode and/or secondary or additional electrodes can be formed to enhance the ejection process.

FIG. 6 also illustrates an alternative form of the ejection electrode 9, which comprises an additional metallised surface on the face of the land 4 which supports the ejection upstand 6,6'. This may help with charge injection and may improve the forward component of the electric field.

FIG. 7 illustrates a partial sectional view through one side of the one of the cells 5 of FIG. 5, with a secondary electrode 19 being shown located on the chamfered face 8 on the cell separator lands 4 and therefore disposed substantially alongside the ejection upstand.

What is claimed is:

1. An apparatus for ejecting particulate material from a liquid, the apparatus comprising a plurality of ejection locations disposed in a linear array, each ejection location having a corresponding ejection electrode, whereby the ejection electrodes are disposed in a row defining a plane;

means to apply an electrical potential to the ejection electrodes to form an electric field at the ejection locations;

means for supplying liquid containing the particulate material to the ejection locations; and at least one secondary electrode disposed transverse to the plane of the ejection electrodes.

2. Apparatus according to claim 1, wherein the at least one secondary electrode includes a secondary electrode for each ejection electrode disposed transverse to the plane of the ejection electrodes.

3. Apparatus according to claim 1, wherein the at least one secondary electrode is common to the ejection locations.

4. Apparatus according to claim 1, wherein in use, a voltage is applied to the ejection electrodes and to the at least one secondary electrode and wherein the voltage on the at least one secondary electrode relative to the voltage on the ejection electrodes is controllable so as to reduce sensitivity of the apparatus to influence by external electric fields.

5. Apparatus according to claim 1, wherein in use the apparatus is located in spaced relation with a substrate and wherein a voltage is applied to the at least one secondary electrode and to the ejection electrodes, and wherein the voltage applied to the at least one secondary electrode is controllable to reduce sensitivity of the apparatus to variations in the spaced relation between the ejection locations and the substrate onto which the particulate matter is ejected.

6. Apparatus according to claim 1, wherein the apparatus has a forward portion and a rearward portion and wherein the at least one secondary electrode is disposed forwardly of the ejection location.

7. Apparatus according to claim 1, wherein the apparatus has a forward portion and rearward portion and wherein, the at least one secondary electrode is disposed rearwardly of the ejection location.

8. Apparatus according to claim 1, wherein the apparatus has a forward portion, a rearward portion and a side portion and the at least one secondary electrode is disposed proximate to the ejection location adjacent the side portion.

9. Apparatus according to claim 1, further comprising at least one tertiary electrode disposed immediately adjacent to the at least one secondary electrode.

10. A method of operating apparatus according to claim 1, to eject particulate matter on to a substrate, the method comprising the steps of selectively applying a first voltage to the ejection electrodes and selectively supplying a second voltage selectively to the at least one secondary electrode.

11. A method according to claim 10, wherein in use a voltage is applied to the at least one secondary electrode and a voltage is applied to the ejection electrodes and wherein, the voltage applied to the secondary electrode relative to the voltage applied to the ejection electrodes is controlled so as to reduce sensitivity of the apparatus to influence by external electric fields.

12. A method according to claim 10, wherein in use a voltage is applied to the at least one secondary electrode and a voltage is applied to the ejection electrodes and wherein, the voltage applied to the at least one secondary electrode relative to the voltage applied to the ejection electrodes is controlled so as to reduce sensitivity of the apparatus to influence by external electric fields.

13. A method according to claim 10, wherein in use a voltage is applied to the at least one secondary electrode and a pulse voltage is applied to the ejection electrodes and the apparatus is locatable in spaced relation to a substrate onto which the particulate matter is to be deposited; and wherein, the voltage applied to the at least one secondary electrode is controlled to reduce sensitivity of the apparatus to variations in the spaced relation between the ejection locations and the substrate onto which the particulate matter is ejected.

14. A method according to claim 10, wherein in use a voltage is applied to the at least one secondary electrode and a voltage is applied to the ejection electrodes, and the voltage applied to the at least one secondary electrode is controlled to lower the pulse voltage applied to the ejection electrodes to achieve controlled ejection.

15. Apparatus according to claim 1, wherein the at least one secondary electrode includes a secondary electrode for each ejection electrode disposed transverse to the plane of the ejection electrodes.

16. Apparatus according to claim 15 wherein the ejection electrodes and the at least one secondary electrode are disposed in spaced relation with a substrate.

17. Apparatus according to claim 16 wherein the ejection electrodes and the at least one secondary electrode cooperate together with respect to one side of the substrate.

18. Apparatus according to claim 15, wherein in use, a voltage is applied to the ejection electrodes and to the at least one secondary electrode and wherein the voltage applied to the at least one secondary electrode relative to the voltage applied to the ejection electrodes is controllable so as to reduce sensitivity of the apparatus to influence by external electric fields.

19. An apparatus for ejecting particulate material from a liquid, the apparatus comprising a plurality of ejection locations disposed in a linear array, each ejection location having a corresponding ejection electrode, said ejection electrodes being disposed in a row defining a plane;

at least one secondary electrode disposed transverse to the plane of the ejection electrodes;

means applying an electrical potential to the ejection electrodes and to the at least one secondary electrode to form an electric field at the ejection locations; and means for supplying liquid containing the particulate material to the ejection locations.

* * * * *